US008226200B2

(12) United States Patent
Kato

(10) Patent No.: US 8,226,200 B2
(45) Date of Patent: Jul. 24, 2012

(54) PRINTING DEVICE AND COMPUTER-READABLE RECORD MEDIUM STORING PROGRAM THEREFOR

(75) Inventor: Shinya Kato, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 904 days.

(21) Appl. No.: 12/325,882

(22) Filed: Dec. 1, 2008

(65) Prior Publication Data

US 2009/0141067 A1 Jun. 4, 2009

(30) Foreign Application Priority Data

Nov. 30, 2007 (JP) ..... 2007-311760

(51) Int. Cl.

| | |
|---|---|
| ***B41J 29/393*** | (2006.01) |
| ***B41J 29/38*** | (2006.01) |
| ***B41J 2/155*** | (2006.01) |
| ***B41J 2/01*** | (2006.01) |

(52) U.S. Cl. ..... 347/19; 347/13; 347/42; 347/101

(58) Field of Classification Search ..... 347/19
See application file for complete search history.

(56) References Cited

U.S. PATENT DOCUMENTS

| | | | |
|---|---|---|---|
| 6,164,740 | A | 12/2000 | Hirai et al. |
| 2005/0220524 | A1 | 10/2005 | Ouchi |
| 2006/0045601 | A1 | 3/2006 | Endo |
| 2006/0114281 | A1 | 6/2006 | Otsuki |

FOREIGN PATENT DOCUMENTS

| | | | |
|---|---|---|---|
| JP | 4-368877 | | 12/1992 |
| JP | HEI08-160685 | A | 6/1996 |
| JP | 9-76487 | | 3/1997 |
| JP | 10-126611 | | 5/1998 |
| JP | 2004-66717 | A | 3/2004 |
| JP | 2005-41079 | | 2/2005 |
| JP | 2005-288753 | | 10/2005 |
| JP | 2006-62142 | A | 3/2006 |
| JP | 2007-245626 | * | 9/2007 |

OTHER PUBLICATIONS

Japanese Official Action dated Oct. 13, 2009 with English translation.

Japanese Official Action dated Jun. 8, 2010 with English translation.

* cited by examiner

*Primary Examiner* — Uyen Chau N Le
*Assistant Examiner* — Kajli Prince
(74) *Attorney, Agent, or Firm* — Scully, Scott, Murphy & Presser, PC

(57) ABSTRACT

An inkjet printing device comprises an inkjet print head, a carriage on which the print head is mounted and which moves to and fro in a main scan direction while facing a sheet, a detector unit mounted on the carriage and detecting whether or not the sheet exists at a position facing a detecting position (prescribed position of the carriage in the main scan direction), an acquisition unit which acquires a print command including size information specifying sheet size, a setting unit which sets the detecting position depending on the size information, a moving unit which moves the carriage to the detecting position set by the setting unit, and a checking unit which checks whether the sheet exists at the position facing the detecting position by use of the detector unit after the carriage is moved to the detecting position and before the printing on the sheet is started.

19 Claims, 8 Drawing Sheets

PRINTING DEVICE AND COMPUTER-READABLE RECORD MEDIUM STORING PROGRAM THEREFOR

CROSS-REFERENCE TO RELATED APPLICATION

This application claims priority under 35 U.S.C. §119 from Japanese Patent Application No. 2007-311760 filed on Nov. 30, 2007. The entire subject matter of the application is incorporated herein by reference.

BACKGROUND

1. Technical Field

The present invention relates to an inkjet printing device and a computer-readable record medium storing a program for an inkjet printing device.

2. Prior Art

There have been widely known inkjet printing devices capable of forming (printing) an image on a sheet (paper, OHP sheet, etc.) by discharging ink onto the sheet from a print head which is mounted on a carriage facing the sheet and moving to and fro in a main scan direction. Many of such inkjet printing devices are designed to detect the width of the sheet in the main scan direction by use of a sensor mounted on the carriage, by which discharge of the ink to the outside of the sheet is prevented.

In a technique disclosed in Japanese Patent Provisional Publication No. 2007-245626 (paragraph 0026, etc., hereinafter referred to as a "patent document #1") in regard to such an inkjet printing device, in cases of full-page printing (borderless printing), the width of the sheet in the main scan direction is detected by use of a sheet detecting unit which is mounted on the carriage, by moving the carriage in the main scan direction at a detecting speed (lower than the speed of the carriage during printing) without making the print head discharge ink drops.

However, with the technique described in the patent document #1 (detecting the width of the sheet by moving the carriage at a detecting speed lower than the speed during printing), the detection of the sheet width (requiring detection of right/left edges of the sheet) takes a long time even though the sheet width can be detected with increased accuracy.

Meanwhile, there are cases where a user of an inkjet printing device loads an erroneous sheet in the device and a sheet in a size different from a sheet size specified by a print command is fed to the print head. In such cases, if the printing on the sheet (in the different size) is carried out by the print head, the ink can be wasted and the inside of the inkjet printing device can be smeared with ink drops missing the sheet.

Thus, appropriate measures have to be taken in such cases where a sheet in a different (incorrect) size has been fed, and in order to take such measures, a technique capable of detecting and checking whether a sheet in a size different from the sheet size specified by the print command has been fed or not with ease and in a short time is being requested. It is of course possible to make the judgment (whether the sheet which has been fed is in the sheet size specified by the print command or not) by detecting the width of the sheet by use of the technique described in the patent document #1. However, the detection of the sheet width by the technique of the patent document #1 takes a long time as mentioned above.

SUMMARY OF THE INVENTION

The present invention, which has been made in consideration of the above problems, is advantageous in that an inkjet printing device capable of checking whether a sheet in a size different from a sheet size specified by a print command has been fed or not with ease and in a short time can be provided. The present invention also provides a computer-readable record medium storing a program for implementing such an inkjet printing device.

In accordance with an aspect of the present invention, there is provided an inkjet printing device comprising a print head which discharges ink onto a sheet, a carriage on which the print head is mounted and which moves to and fro in a main scan direction while facing the sheet, a detector unit which is mounted on the carriage and detects whether or not the sheet exists at a position facing a detecting position as a prescribed position of the carriage in the main scan direction, an acquisition unit which acquires a print command including size information specifying size of the sheet for which printing is requested, a setting unit which sets the detecting position depending on the size information included in the print command acquired by the acquisition unit, a moving unit which moves the carriage to the detecting position set by the setting unit, and a checking unit which checks whether the sheet exists at the position facing the detecting position or not by use of the detector unit after the carriage is moved to the detecting position by the moving unit and before the printing on the sheet is started.

In the inkjet printing device configured as above, when a print command (including the size information specifying the size of the sheet for which printing is requested) is acquired by the acquisition unit, the detecting position is set by the setting unit depending on the size information included in the print command. The detecting position is a prescribed position of the carriage in the main scan direction, at which the detector unit mounted on the carriage detects whether or not the sheet exists at the position facing the detecting position. After the carriage is moved to the detecting position by the moving unit and before the printing on the sheet is started, whether the sheet exists at the position facing the detecting position or not is checked by the checking unit by use of the detector unit. Therefore, it is unnecessary to detect the right and left edges (width) of the currently fed sheet by reciprocating the carriage in the main scan direction in order to judge whether or not (the size of) the sheet which has been fed is identical with that specified by the print command. The judgment can be made just by moving the carriage to the detecting position (which is set depending on the sheet size specified by the print command) and checking the presence/absence of the sheet at the (one) detecting position. Therefore, whether a sheet in a size different from the sheet size specified by the print command has been fed or not can be checked with ease and in a short time.

In accordance with another aspect of the present invention, there is provided a computer-readable record medium storing computer-readable instructions that cause a computer of an inkjet printing device (equipped with a print head which discharges ink onto a sheet, a carriage on which the print head is mounted and which moves to and fro in a main scan direction while facing the sheet, and a detector which is mounted on the carriage and detects whether or not the sheet exists at a position facing a detecting position as a prescribed position of the carriage in the main scan direction) to execute an acquisition step of acquiring a print command including size information specifying size of the sheet for which printing is requested, a setting step of setting the detecting position depending on the size information included in the print command acquired by the acquisition step, a moving step of moving the carriage to the detecting position set by the setting step, and a checking step of checking whether the sheet exists at the position facing the detecting position or not by use of the detector after the carriage is moved to the detecting position by the moving step and before the printing on the sheet is started.

By making a computer of an inkjet printing device operate according to the computer-readable instructions acquired (loaded, installed, etc.) from the computer-readable record medium, effects similar to those of the inkjet printing device described above can be achieved.

According to a further aspect of the invention, there is provided a method of checking presence/absence of a sheet for an inkjet printing device which is equipped with a print head which discharges ink onto a sheet, a carriage on which the print head is mounted and which moves to and fro in a main scan direction while facing the sheet, and a detector which is mounted on the carriage and detect presence/absence of the sheet at a detecting position. The method includes an acquisition step of acquiring a print command including size information specifying size of the sheet for which printing is requested, a setting step of setting the detecting position depending on the size information included in the print command acquired by the acquisition step, a moving step of moving the carriage to locate the detector at the detecting position set by the setting step; and a checking step of checking presence/absence of the sheet at the detecting position by use of the detector located at the detecting position.

According to the above method, effects similar to those of the inkjet printing device described above can be achieved.

Other objects, features and advantages of the present invention will become more apparent from the consideration of the following detailed description taken in conjunction with the accompanying drawings.

BRIEF DESCRIPTION OF THE ACCOMPANYING DRAWINGS

DETAILED DESCRIPTION OF THE EMBODIMENT

Figure 1:
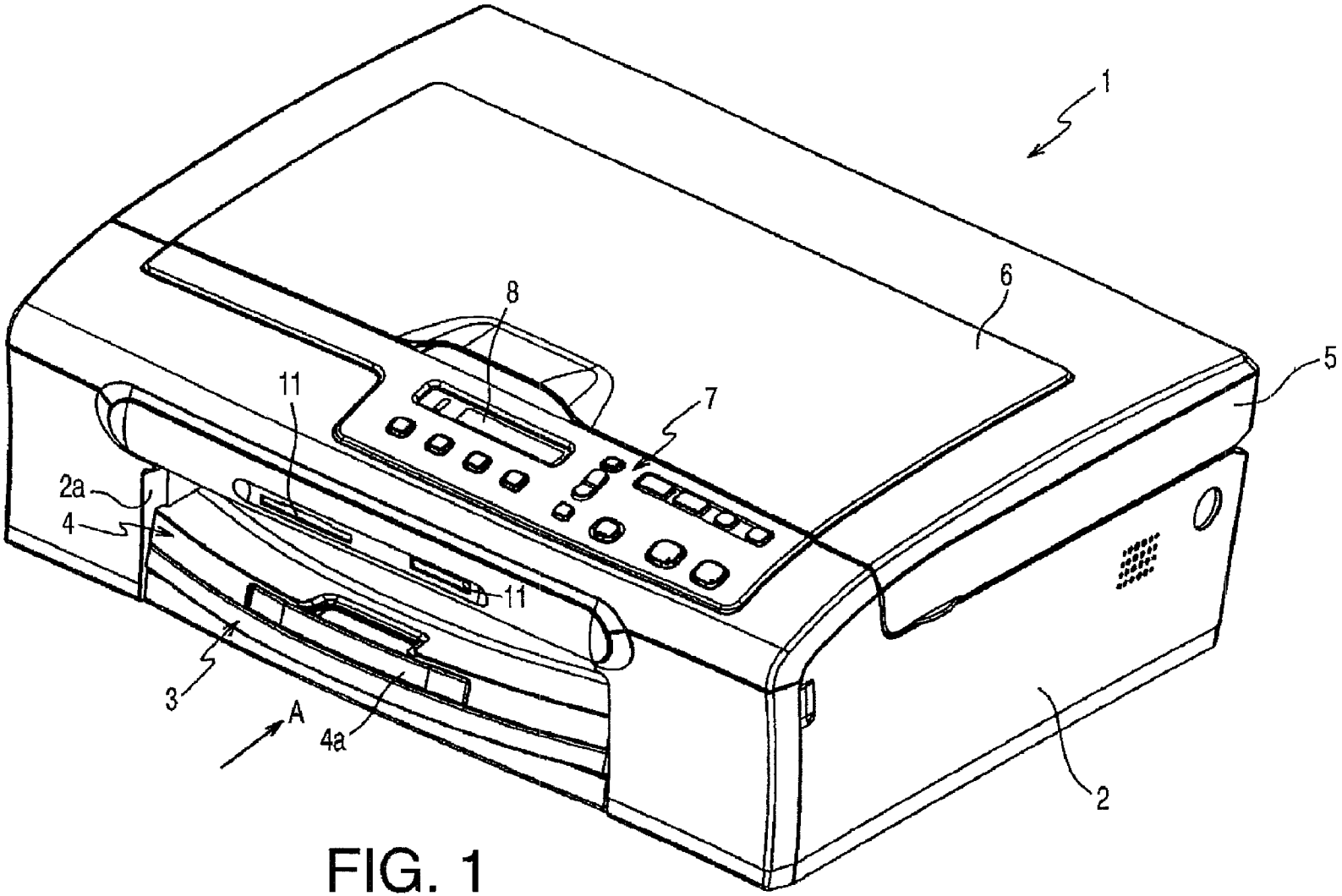
FIG. 1 is a perspective view showing the exterior configuration of an MFP (Multi-Function Peripheral) as an example of an inkjet printing device in accordance with an embodiment of the present invention.

Referring now to the drawings, a description will be given in detail of a preferred embodiment in accordance with the present invention.

FIG. 1 is a perspective view showing the exterior configuration of an MFP (Multi-Function Peripheral) 1 as an example of an inkjet printing device in accordance with an embodiment of the present invention. The MFP 1 has various functions such as the so-called facsimile function, printer function, scanner function and copy function. Especially for the printer function, the MFP 1 of this embodiment is capable of checking whether a sheet in a size different from a sheet size specified by the print command has been fed or not with ease and in a short time.

As shown in FIG. 1, the front of the housing 2 of the MFP 1 has an opening 2*a*. Into the opening 2*a*, a lower tray 3 (storing a stack of sheets) and an upper tray 4 (storing a stack of sheets) capable of sliding on the lower tray 3 can be inserted in the direction of arrow A shown in FIG. 1.

Each sheet stored in a tray (3, 4) is fed to an inkjet print head 21 installed inside the housing 2, undergoes the printing by the inkjet print head 21, and is ejected onto the top surface of the upper tray 4. Thus, the upper tray 4 serves also as an output tray for holding the printed sheets. The upper tray 4 is equipped with a stopper 4*a* which is drawable in the direction opposite to the arrow A in FIG. 1, which prevents the printed sheets from dropping from the top surface of the upper tray 4.

An image scanning unit 5 for performing document scanning (scanning of an image on a document) for the copy function and the facsimile function is provided at the top of the housing 2. The image scanning unit 5 is capable of rotating (opening upward and closing downward) with respect to the main body of the MFP 1 around an unshown axial part at the rear and of the housing 2. The top of the image scanning unit 5 is formed of a glass plate, on which the document to be scanned is placed. The glass plate is covered by a document cover 6 which is rotatable (upward and downward) around an axis extending in a rear part of the image scanning unit 5. After the document cover 6 is opened upward and the document to be scanned is placed on the glass plate by the user, the image on the document is scanned by a document image scanner (e.g. CIS (Contact Image Sensor)) which moves to and fro in the main scan direction beneath the glass plate.

A front part of the top of the housing 2 (in front of the document cover 6) is provided with an operation panel 7 including various operation buttons and a liquid crystal display 8 for displaying operational instructions, status of a process in progress, etc. The operation buttons include a start button and a stop button. In response to various user operations (pressing of the operation buttons), a variety of necessary information (settings of the MFP 1, operational instructions, messages, etc.) is displayed on the liquid crystal display 8.

An upper part of the front of the housing 2 (above the opening 2*a*) is provided with an external memory slot 11 into which an external memory (Compact Flash®, Smart Media®, Memory Stick®, SD Card®, xD-Picture Card®, etc.) can be inserted. Date stored in the external memory inserted in the external memory slot 11 can be loaded into an internal memory of the MFP 1 and printed on a sheet by the inkjet print head 21.

Figure 2:
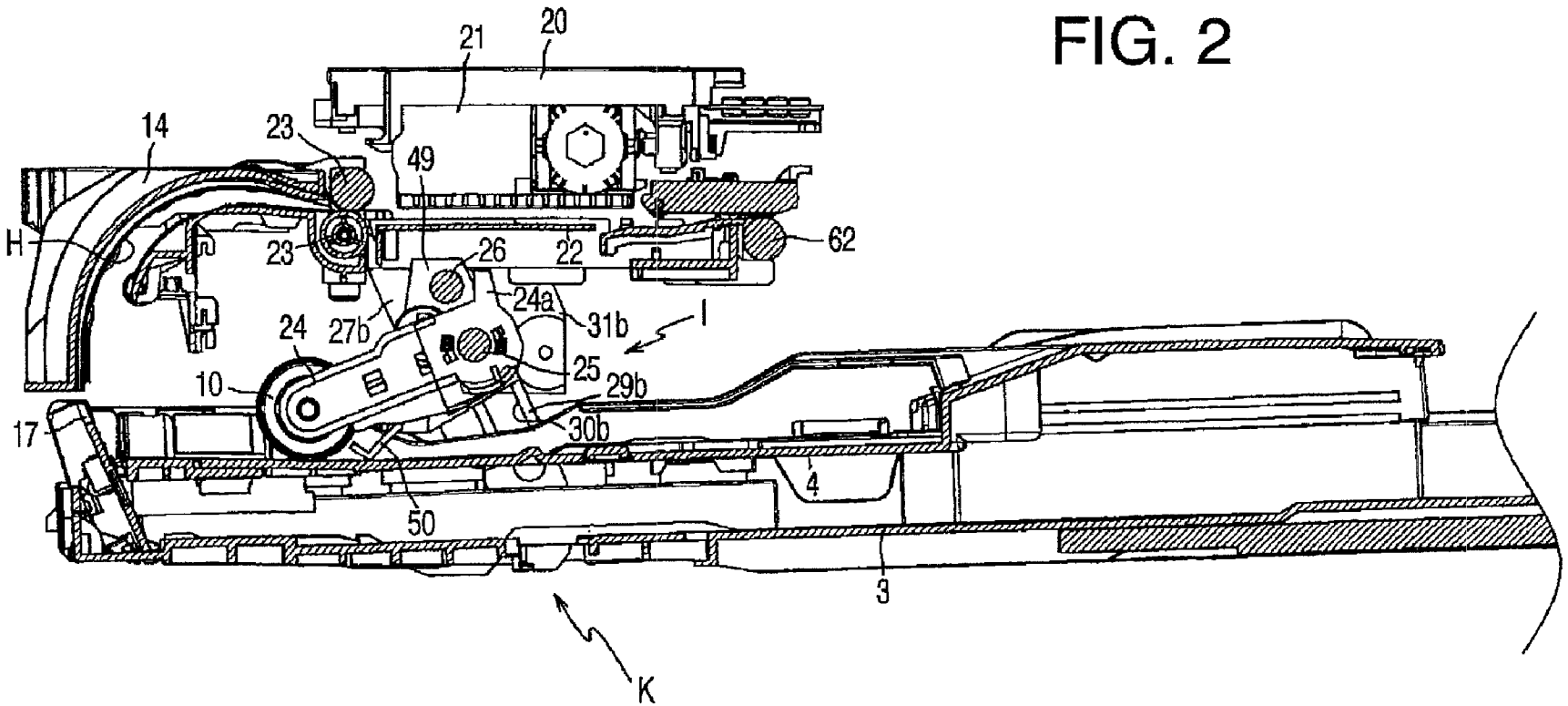
FIG. 2 is a schematic cross-sectional view showing the internal structure of a housing of the MFP (a state in which an upper tray has been set on a lower tray).
Figure 3:
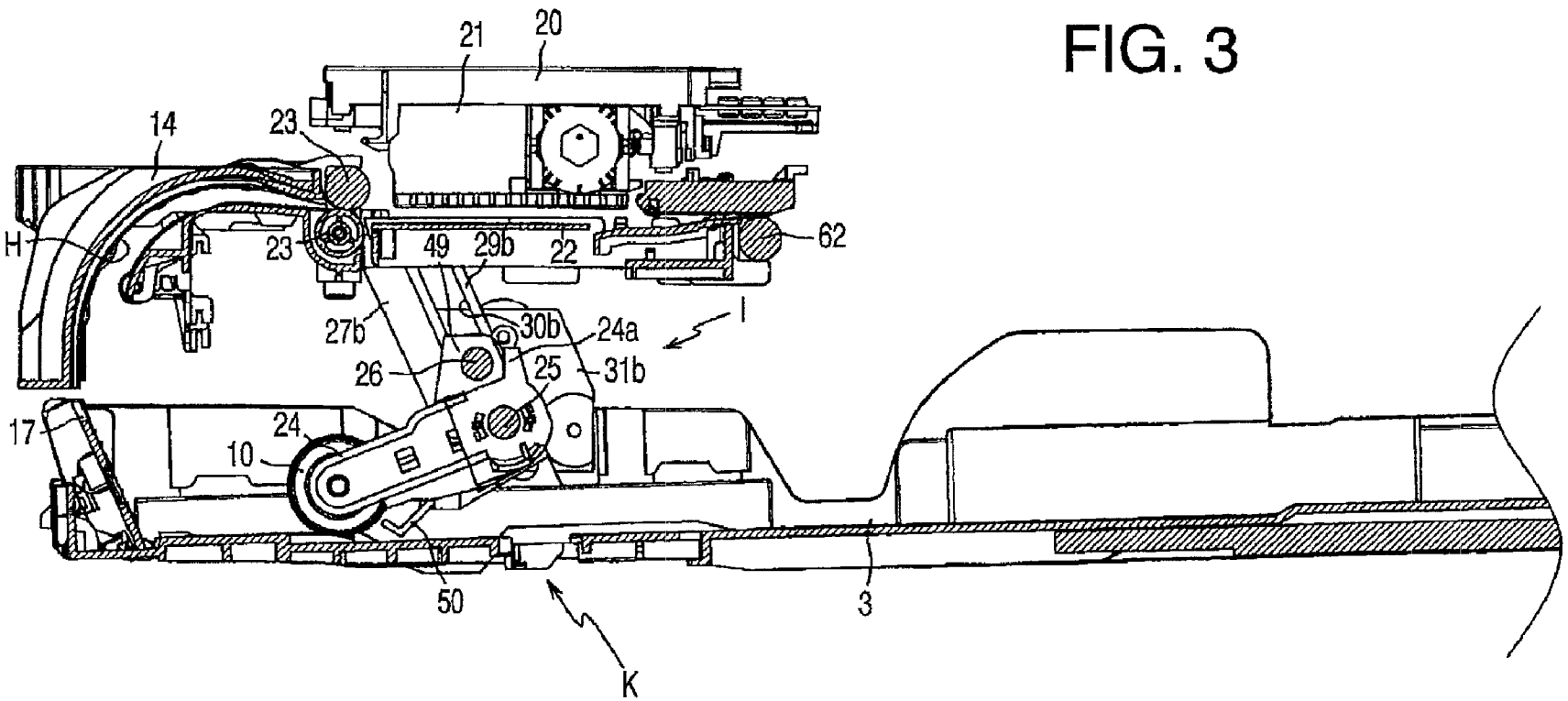
FIG. 3 is a schematic cross-sectional view showing the internal structure of the housing (a state in which the upper tray has been removed from the lower tray).
Figure 4:
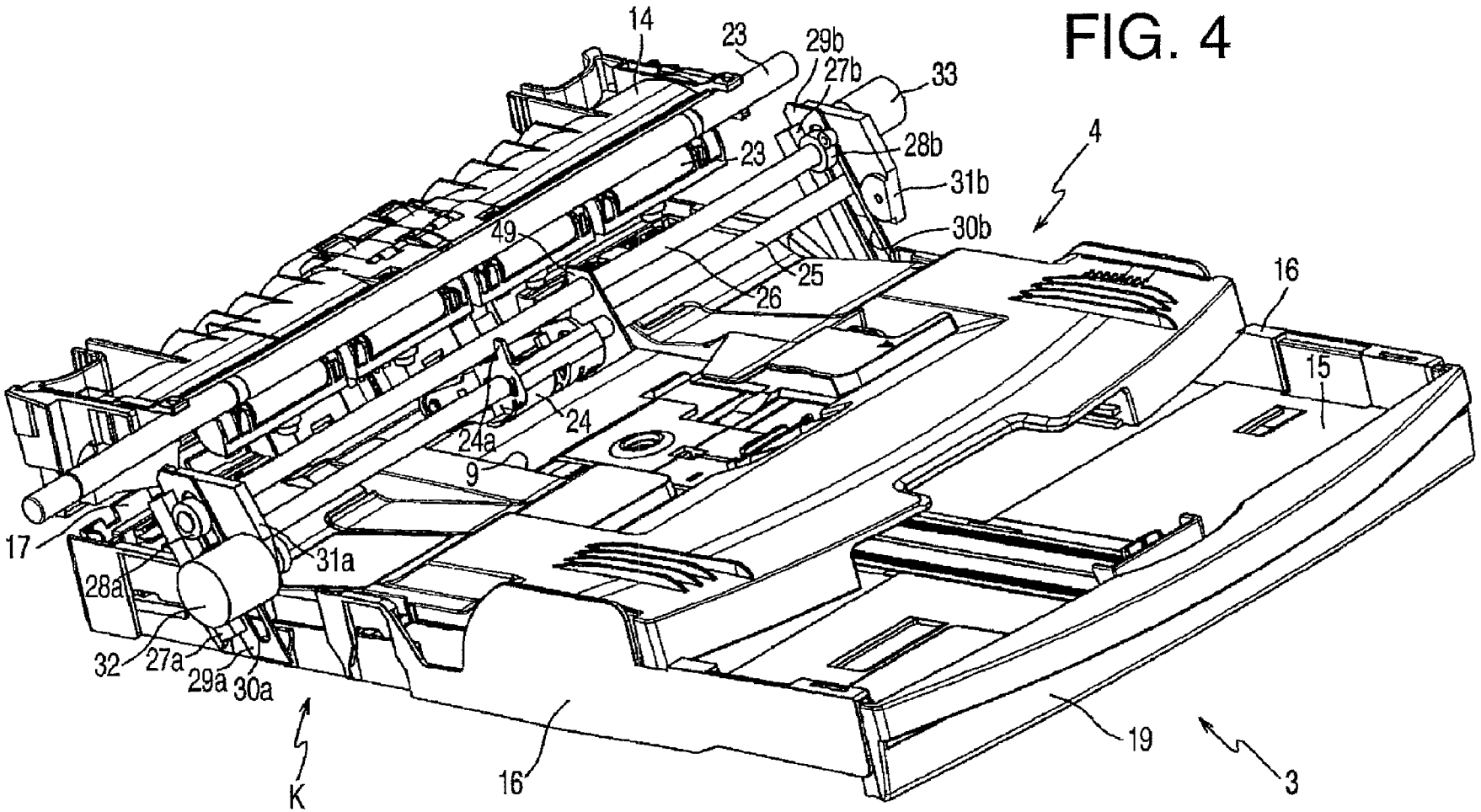
FIG. 4 is a perspective view mainly showing the exterior configuration of a sheet feed unit of the MFP.

Next, the internal structure of the housing 2 will be described below referring to FIGS. 2-4. FIGS. 2 and 3 are schematic cross-sectional views showing the internal structure of the housing 2, wherein FIG. 2 shows a state in which the upper tray 4 has been set on the lower tray 3 while FIG. 3 shows a state in which the upper tray 4 has been removed from the lower tray 3. FIG. 4 is a perspective view mainly showing the exterior configuration of a sheet feed unit K, wherein the inkjet print head 21 and a carriage 20 (shown in FIGS. 2 and 3) are unshown for the sake of simplicity of illustration.

As shown in FIGS. 2 and 3, the housing 2 of the MFP 1 mainly contains a sheet feed roller 10 as a component of the sheet feed unit K, a feeding guide 14 which forms a U-shaped feeding path H for feeding the sheet supplied from the sheet feed roller 10, a pair of feed rollers 23 for feeding the sheet supplied from the feeding path H, a platen 22 which supports the sheet supplied from the feed rollers 23, the carriage 20 which moves to and fro in the main scan direction while maintaining a prescribed distance from the platen 22, the inkjet print head 21 which is mounted on the carriage 20 for discharging ink onto a surface of the sheet opposite to the platen 22, and a sheet ejection roller 62 for ejecting the sheet on which an image has been printed by the inkjet print head 21.

Each (uppermost) sheet in the sheet stack stored in a tray (3, 4) is pulled out by the sheet feed roller 10, passes through the feeding path H, and is fed by the pair of feed rollers 23 to the position between the inkjet print head 21 and the platen 22. After undergoing the printing by the inkjet print head 21, the printed sheet is ejected onto the top surface of the upper tray 4.

The sheet feed unit K mainly includes the lower tray 3, the upper tray 4, the sheet feed roller 10 which is placed above the upper tray 4, an arm 24 which is supported to be rotatable (swingable) and equipped with the sheet feed roller 10 at an end (distal end), and a moving mechanism I which moves the arm 24 (sheet feed roller 10) in a direction intersecting with the surface of the sheet stack stored in each tray (3, 4).

The lower tray 3 is formed substantially in a box shape with no top as shown in FIG. 4. The lower tray 3 is made up of a base plate 15, side plates 16, a front plate 19 and a leaned rear plate 17 (see FIGS. 2 and 3). The plates 16, 17 and 19 are standing from the periphery (edges) of the base plate 15.

As shown in FIGS. 2 and 3, the leaned rear plate 17, extending from the lower tray 3 continuously to the upper tray 4, serves for separating a sheet from the sheet stack stored in each tray (3, 4). The leaned rear plate 17 stands at an obtuse angle from the surface of the sheet stack stored in each tray (3, 4), while making contact with the front end (in the sheet feed direction) of the sheet stack stored in each tray (3, 4).

Inside the lower tray 3, slide guides (unshown) capable of symmetrically shifting from both sides (side plates 16) toward the center of the lower tray 3 are provided in order to guide (restrict) the sheet stack in its width direction. With the slide guides, the center (center line extending in the sheet feed direction) of the stack of sheets stored in the lower tray 3 can be aligned with that of the lower tray 3 irrespective of the sheet size.

Meanwhile, the upper tray 4 is formed in a flat plate-like shape as shown in FIG. 4 to be slidable on (along) the side plates 16 of the lower tray 3. For printing on a sheet stored in the upper tray 4, the upper tray 4 is pressed inward (leftward in FIG. 4). For printing on a sheet stored in the lower tray 3, the upper tray 4 is pulled outward (rightward in FIG. 4) or pulled out (removed) from the lower tray 3.

The upper tray 4 has a concave part 9 extending from the rear end toward the front of the tray and having a prescribed width, in which a stack of sheets is stored. The width of the concave part 9 is smaller than that of the lower tray 3. Thus, the upper tray 4 in this embodiment is used for storing sheets in relatively small sizes (L size (89 mm×127 mm), postcard, Japanese postcard (100 mm×148 nm), 4"×6" (101.6 mm×152.4 mm), etc.), while the lower tray 3 is used for storing sheets in relatively large sizes (letter (215.9 mm×279.4 mm), A4 (210 mm×297 mm), B5 (182 mm×257 mm), B6 (128 mm×182 mm)).

The center (center line extending in the sheet feed direction) of the sheet stack stored in the upper tray 4 is aligned with that of the sheet stack stored in the lower tray 3. Thus, the central position (in the width direction) of each sheet extracted and fed from the upper tray 4 coincides with that of each sheet extracted and fed from the lower tray 3.

As shown in FIGS. 2 and 3, the sheet feed roller 10 (placed above the trays 3 and 4) is supported by the distal end of the arm 24 to be rotatable clockwise in FIGS. 2 and 3. The sheet feed roller 10 makes contact with the uppermost sheet in the sheet stack stored in the tray 3 or 4 and feeds the uppermost sheet toward the leaned rear plate 17. The arm 24 supporting the sheet feed roller 10 is equipped with multiple gear wheels arranged in a line, via which the sheet feed roller 10 is driven and rotated.

As shown in FIG. 4, the other end (proximal end) of the arm 24 (opposite to the sheet feed roller 10) is rotatably supported by a first shaft 25 which extends in the width direction above the trays 3 and 4.

The proximal end of the arm 24 is formed to have a projection 24*a* as shown in FIGS. 2 and 3, which makes contact with a second shaft 26 (extending in parallel with and obliquely above the first shaft 25) as the arm 24 rotates counterclockwise around the first shaft 25. Thus, the counterclockwise rotation (angular range) of the arm 24 is restricted by the projection 24*a*.

Incidentally, when a tray 3 or 4 is loaded into the housing 2, the arm 24 is rotated clockwise by an unshown mechanism for smooth loading of the tray.

A bracket 49, penetrated by the first and second shafts 25 and 26, is placed beside the arm 24. A sheet sensor 50 for detecting the sheet stack stored in the tray 3 or 4 (see FIGS. 2 and 3) is attached to an end of the bracket 49 facing the tray.

As shown in FIGS. 2 and 3, the sheet sensor 50 includes a probe which is formed in a V-shape, whose folding point makes contact with the surface of the sheet stack stored in the tray 3 or 4 and whose proximal end is held by a pendulum.

The sheet sensor 50 outputs an ON signal when the angle between the surface of the sheet stack and a part (line) of the probe correcting the proximal end and the folding point is within a prescribed angle, while outputting an OFF signal when the angle exceeds the prescribed angle. Incidentally, the sheet sensor 50 is placed at an appropriate position (relative to the arm 24 (sheet feed roller 10)) so that the sheet feed roller 10 is necessarily in contact with the sheet stack when the sheet sensor 50 is outputting the ON signal (i.e. when the angle is within the prescribed angle).

The moving mechanism I, for integrally moving the arm 24 and the sheet feed roller 10 in the direction intersecting with the surface of the sheet stack stored in each tray (3, 4), includes a pair of rack gears 27*a* and 27*b* (each having numbers of cogs (unshown) arranged in a line parallel to the Leaned rear plate 17) situated at positions sandwiching the trays 3 and 4 in the width direction and a pair of pinion gears 28*a* and 28*b* engaging with and moving along the rack gears 27*a* and 27*b*, respectively, as shown in FIG. 4.

Support plates 29*a* and 29*b* (as a pair) stand inside the main body to sandwich the trays 3 and 4 in the width direction, and the rack gears 27*a* and 27*b* are fixed on the support plates 29*a* and 29*b*, respectively. Specifically, the rack gear 27*a* is fixed on a surface of the support plate 29*a* opposite to the trays 3 and 4, while the rack gear 27*b* is fixed on a surface of the support plate 29*b* facing the trays 3 and 4.

The support plate 29*a* has an elongated hole 30*a* extending in parallel with the leaned rear plate 17 (in parallel with the rack gears 27*a* and 27*b*), while having a link plate 31*a* fixed on its surface opposite to the rack gear 27*a*. Similarly, the support plate 29*b* has an elongated hole 30*b* extending in parallel with the leaned rear plate 17 (in parallel with the rack gears 27*a* and 27*b*), while having a link plate 31*b* fixed on its surface opposite to the rack gear 27*b*.

The first shaft 25 supporting the arm 24 is linked with the link plates 31*a* and 31*b*. An end of the first shaft 25 on the link plate 31*a* side is linked with an LF (Line Feed) motor 32 (mounted on the link plate 31*a*) via an unshown gear mechanism. The driving force of the LF motor 32 is transmitted to the sheet feed roller 10 via the first shaft 25 and the gear wheels of the arm 24.

Meanwhile, the second shaft 26 penetrates the elongated hole 30*a* of the support plate 29*a*, the link plate 31*a*, the elongated hole 30*b* of the support plate 29*b*, and the link plate 31*b*. Both ends of the second shaft 26 are firmly fit into the pinion gears 28*a* and 28*b*, respectively. An end of the second shaft 26 on the link plate 31*b* side is linked with an elevator motor 33 (mounted on the link plate 31*b*) via an unshown gear mechanism.

In the moving mechanism I configured as above, when the elevator motor 33 is activated, the pinion gears 28*a* and 28*b* (connected together by the second shaft 26) rotate accordingly and move along the rack gears 27*a* and 27*b*, respectively. In conjunction with the movement of the pinion gears 28*a* and 28*b*, the link plates 31*a* and 31*b* and the first shaft 25 also move along the rack gears 27*a* and 27*b*. Consequently, the arm 24 (supported by the first shaft 25) and the sheet feed roller 10 move integrally along the rack gears 27*a* and 27*b*.

Since the rack gears 27*a* and 27*b* extend in the direction intersecting with the surface of the sheet stack stored in each tray (i.e. in parallel with the leaned rear plate 17), the moving mechanism I is capable of integrally moving the arm 24 and the sheet feed roller 10 in the direction intersecting with the surface of the sheet stack (i.e. in parallel with the leaned rear plate 17).

Thus, the angle between the arm 24 and the surface of the sheet stack can be set at an appropriate angle depending on the sheet type even when the height of the sheet stack decreases with the consumption of the sheets stored in the tray. Therefore, stable sheet feeding performance can be realized irrespective of the amount and type of the sheets stored in each tray (3, 4).

The feed rollers 23 and the sheet ejection roller 62, on the upstream side and downstream side of the inkjet print head 21 (carriage 20) in the sheet feed direction, are both driven by driving force transmitted from the LF motor 32. The feed rollers 23 and the sheet ejection roller 62 are driven in sync with each other (intermittently during printing), by which the sheet is repeatedly fed in units of a prescribed linefeed width (length) when it undergoes the image printing by the inkjet print head 21.

The carriage 20 is driven (slid) by driving force which is transmitted from a CR motor 73 (see FIG. 5) via a belt drive mechanism, for example, Ink cartridges (unshown) storing inks of prescribed colors (e.g. CMYK (cyan, magenta, yellow, black)) are loaded in the MFP 1 independently of the inkjet print head 21. The inks are supplied from the ink cartridges to the inkjet print head 21 through ink tubes. The inks are discharged from the inkjet print head 21 onto the sheet as minute ink drops while the carriage 20 (holding the head 21) is reciprocated (moved to and fro), by which an image is printed on the sheet being fed on the platen 22.

The main frame of the MFP 1 is equipped with a linear encoder 77 (see FIG. 5) for detecting the position of the carriage 20. An encoder strip of the linear encoder 77 extends in the main scan direction. In the encoder strip, light-transmissive parts (letting through light) and light-blocking parts (blocking light) are alternately arranged at prescribed intervals along the length of the strip to form a specific pattern.

Meanwhile, the carriage 20 is equipped with an unshown optical sensor (as a transmissive sensor corresponding to the linear encoder 77) at a position corresponding to the encoder strip. Together with the carriage 20, the optical sensor moves to and fro along the length of the encoder strip while detecting the pattern of the encoder strip, by which the position of the carriage 20 in the main scan direction can be detected.

The carriage 20 is further equipped with a media sensor 51 (see FIG. 5) for detecting the presence/absence of a sheet (print medium) on the platen 22. The media sensor 51 includes a light source and a photoreceptor element. Light emitted from the light source is reflected by the sheet (when the sheet has been fed to the platen 22) or the platen 22 (when the sheet has not been fed to the platen 22), and the reflected light is received by the photoreceptor element. The photoreceptor element outputs a signal corresponding to the amount of the received light, by which whether a sheet exists at a prescribed position in the main scan direction (facing the media sensor 51) or not can be detected. In this embodiment, the position in the main scan direction at which the media sensor 51 detects the presence/absence of the sheet will be referred to as a "detecting position".

Figure 5:
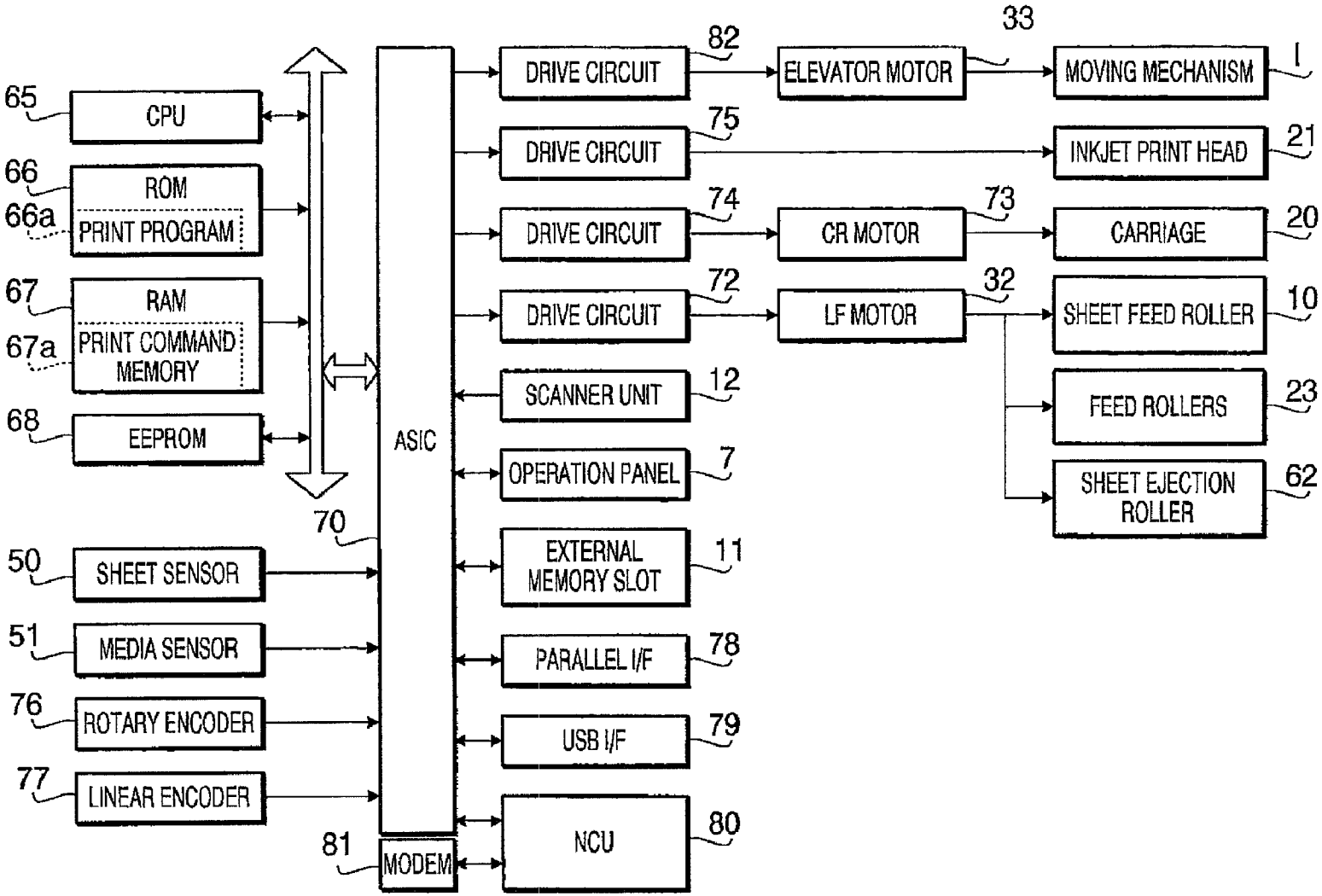
FIG. 5 is a block diagram showing an example of the electrical configuration of the MFP.

FIG. 5 is a block diagram showing an example of the electrical configuration of the MFP 1. The MFP 1 includes a microcomputer mainly composed of a CPU (Central Processing Unit) 65, a ROM (Read Only Memory) 66, a RAM (Random Access Memory) 67 and an EEPROM (Electrically Erasable and Programmable ROM) 68. The microcomputer is connected to an ASIC (Application-Specific Integrated Circuit) 70 via a bus 69.

Figure 6:
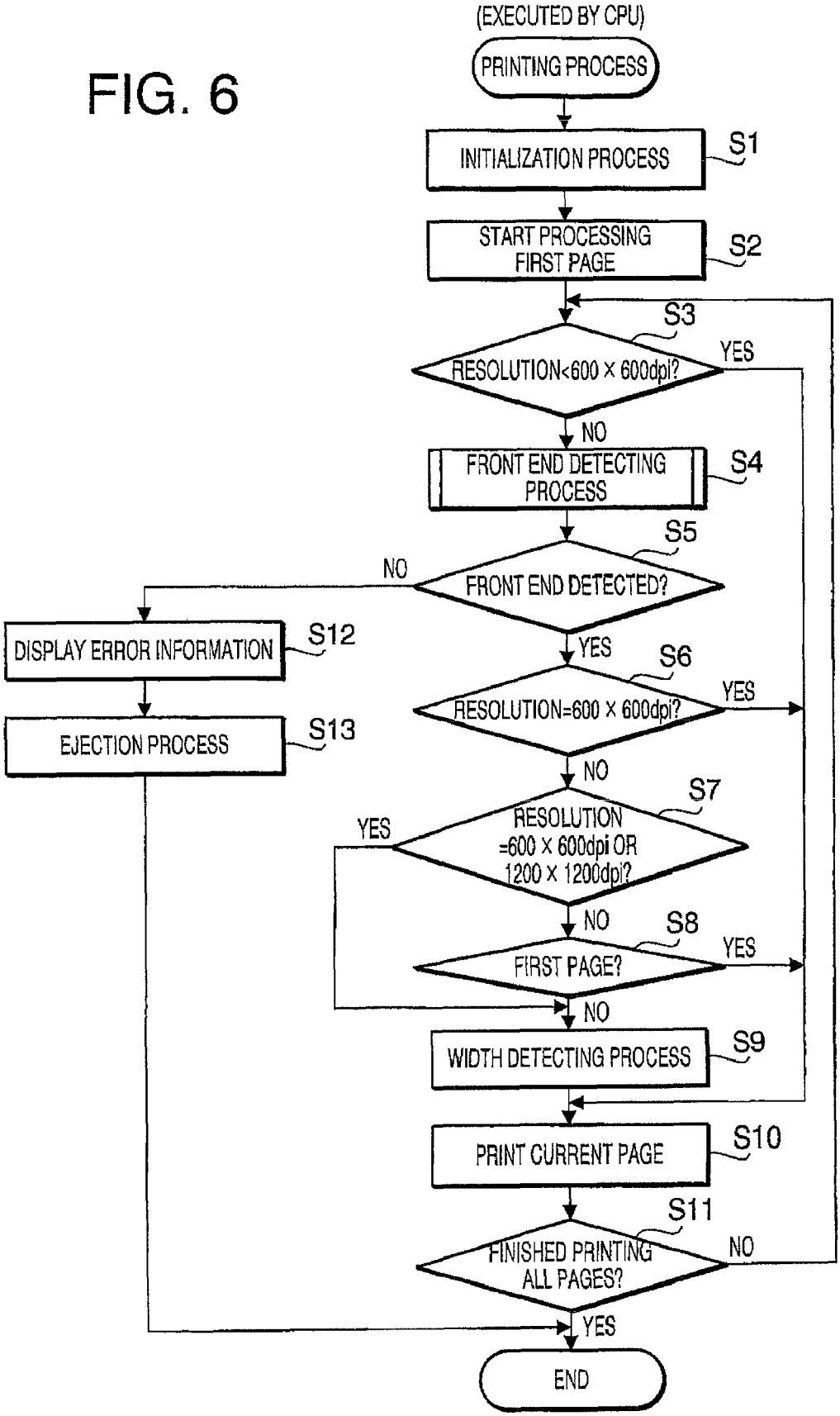
FIG. 6 is a flow chart showing a printing process which is executed by the MFP.

The ROM 66 stores programs and data for controlling various operations of the MFP 1, such as a print processing program 66*a* for executing a printing process which will be explained later referring to FIG. 6. The RAM 67 is used as a storage area or work area for temporarily storing various data used for the execution of the programs by the CPU 65.

A print command memory 67*a* is reserved in the RAM 67, in which the contents of a print command inputted to the MFP 1 is temporarily stored when the printing process (explained later referring to FIG. 6) is executed. The EEPROM 68 is a nonvolatile memory for storing settings, flags, etc. of the MFP 1 that have to be retained even after the turning OFF of the MFP 1.

The ASIC 70 executes rotation control of the elevator motor 33, by generating phase excitation signals, etc. (for driving the elevator motor 33) according to instructions from the CPU 65 and supplying the signals to a drive circuit 82 of the elevator motor 33.

The drive circuit 82, as a circuit for driving the elevator motor 33 linked with the moving mechanism I, generates an electric signal for rotating the elevator motor 33 according to the signals supplied from the ASIC 70. The torque of the elevator motor 33 rotating in response to the electric signal is transmitted to the pinion gears 28*a* and 28*b* of the moving mechanism I, by which the arm 24 and the sheet feed roller 10 are moved in conjunction with the pinion gears 28*a* and 28*b*.

A drive circuit 75 is a circuit for making the inkjet print head 21 selectively discharge the inks onto the sheet with proper timing. The drive circuit 75 executes the drive control of the inkjet print head 21 in response to a signal which is generated and outputted by the ASIC 70 based on a drive control procedure supplied from the CPU 65.

The ASIC 70 further executes rotation control of the CR motor 73, by generating phase excitation signals, etc. (for driving the CR motor 73) according to instructions from the CPU 65 and supplying the signals to a drive circuit 74 of the CR motor 73.

The drive circuit 74, as a circuit for driving the CR motor 73 linked with the carriage 20, generates an electric signal for rotating the CR motor 73 according to the signals supplied from the ASIC 70. The torque of the CR motor 73 rotating in response to the electric signal is transmitted to the carriage 20 via an unshown belt drive mechanism, by which the reciprocation (to-and-fro movement) of the carriage 20 is controlled.

The ASIC 70 further executes rotation control of the LF motor 32, by generating phase excitation signals, etc. (for driving the LF motor 32) according to instructions from the CPU 65 and supplying the signals to a drive circuit 72 of the LF motor 32.

The drive circuit 72, as a circuit for driving the LF motor 32 linked with the sheet feed roller 10, the feed rollers 23 and the sheet ejection roller 62, generates an electric signal for rotating the LF motor 32 according to the signals supplied from the ASIC 70. The torque of the LF motor 32 rotating in response to the electric signal is transmitted to the sheet feed roller 10, the feed rollers 23 and the sheet ejection roller 62 via a driving mechanism.

The sheet sensor 50 (for detecting the sheet stack stored in each tray (3, 4)), the media sensor 51 (mounted on the carriage 20 for detecting the presence/absence of a sheet at the "detecting position" facing itself), the linear encoder 77 (for detecting the moving distance (position) of the carriage 20), and a rotary encoder 76 for detecting the rotating angle of the feed rollers 23 are also connected to the ASIC 70.

Further connected to the ASIC 70 are a scanner unit 12, the operation panel 7 (operated by the user for inputting instructions, etc.), the external memory slot 11 (into which an external memory can be inserted), a parallel interface 78 for data communication with an external device via a parallel cable, and a USB interface 79 for data communication with an external device via a USB cable. For the implementation of the facsimile function, an NCU (Network Control Unit) 80 and a modem 81 are also connected to the ASIC 70.

In the following, the printing process which is executed by the MFP 1 of this embodiment will be explained referring to FIG. 6. FIG. 6 is a flow chart showing the printing process. The printing process (as the printer function of the MFP 1) is executed according to a print command which is supplied from a personal computer connected to the MFP 1, for example.

At the start of the printing process (in response to the print command from a personal computer, for example), the MFP 1 (specifically, the CPU 65 (ditto for the following steps)) executes an initialization process (S1). In the initialization process, various settings, flags, etc. of the MFP 1 are initialized and the print command supplied from the personal computer is stored in the print command memory 67*a*. The print command includes information on the size of the sheet to be printed on, the resolution of the image to be printed, the number of copies, layout, etc. After finishing the initialization process (S1), the MFP 1 generates print data according to the contents of the print command and starts processing the first page (S2).

In the processing of the first page (currently processed page), the MFP 1 first judges whether the resolution specified by the print command is lower than 600×600 dpi or not (S3). When the resolution is lower than 600×600 dpi (S3: YES), the MFP 1 carries out the printing of the first page (currently processed page) (S10) without executing a front end detecting process (S4) or a width detecting process (S9) which will be explained later. By the omission of the front end detecting process (S4) and the width detecting process (S9), the printing of the image can be executed at high speed in the case where the resolution specified by the print command is lower than 600×600 dpi, even though the image quality can become lower since the position of the sheet in the sheet feed direction and in the main scan direction with respect to the print head 21 can not be recognized correctly.

On the other hand, when the resolution is 600×600 dpi or higher in S3 (S3: NO), the MFP 1 executes the front end detecting process (S4) which will be explained later, by which the front end of the sheet being fed at the position facing the carriage 20 is detected. Subsequently, the MFP 1 judges whether or not the front end of the sheet has been detected successfully by the front end detecting process (S5).

When the front end of the sheet has not been detected (S5: NO), the MFP 1 (judging that a sheet in a size different from the sheet size specified by the print command has been fed) displays error information (S12). For example, a message "INCORRECT SHEET SIZE. PLEASE SET SHEET OF CORRECT SIZE" is displayed on the liquid crystal display 8. Thereafter, the MFP 1 ejects the currently fed sheet without executing the printing thereon (ejection process) (S13) and ends the printing process of FIG. 5.

Since the sheet (in an incorrect size) is immediately ejected from the MFP 1 without being printed on, wastage of the inks (due to useless printing on the sheet in an incorrect size) and smearing of the inside of the MFP 1 (due to ink drops missing the sheet) can be prevented.

On the other hand, when the front end of the sheet has been detected in S5 (S5: YES), the MFP 1 judges whether the resolution is 600×600 dpi or not (S6). When the resolution is not 600×600 dpi (S6: NO), the MFP 1 judges whether or not the resolution is higher than 1200×1200 dpi (S7).

When the resolution is equal to or less than 1200×1200 dpi (S7: NO), the MFP 1 judges whether the currently processed page is the first page or not (S8). If affirmative (S8: YES), the MFP 1 executes the width detecting process (S9).

When the resolution specified by the print command is higher than 1200×1200 dpi (S7: YES), the MFP 1 executes the width detecting process (S9) while skipping the step S8.

As above, the width detecting process (S9) is executed when the resolution specified by the print command is higher than 1200×1200 dpi, and when the resolution specified by the print command is equal to or less than 1200×1200 dpi (according to the embodiment, when the resolution is 600×1200 dpi or 1200×1200 dpi) and the currently processed page is the first page.

In the width detecting process (S9), the carriage 20 is gradually moved in the main scan direction and the position of the sheet (which has been fed to the position facing the carriage 20) in the main scan direction is detected by the media sensor 51 mounted on the carriage 20.

Thus, a high-quality image can be printed on the sheet thanks to the correct recognition of the position of the sheet in the main scan direction with respect to the print head 21 when the resolution specified by the print command is higher than 1200×1200 dpi, and when the resolution specified by the print command is 600×1200 dpi or 1200×1200 dpi and the currently processed page is the first page.

When the resolution specified by the print command is judged to be 600×600 dpi in S6 (S6: YES) or the currently processed page is judged not to be the first page (i.e. judged to be the second page or after) in S8 (S8: NO), the MFP 1 carries out the printing of the currently processed page (S10) without executing the width detecting process (S9).

Thus, in the case where the resolution specified by the print command is 600×600 dpi (S6: YES) and in the case where the resolution specified by the print command is 600×1200 dpi or 1200×1200 dpi (S7: YES) and the currently processed page is the second page or after (S8: NO), the image printing can be executed at higher speed (thanks to the omission of the width detecting process (S9)) compared to the above case where the step S9 is executed, even though the position of the sheet in the main scan direction with respect to the print head 21 can not be recognized correctly.

After carrying out the printing of the currently processed page (S10), the MFP 1 judges whether the printing has been finished for all pages or not (S11). If not finished (S11: NO), the MFP 1 returns to S3 to repeat the process from S3 for the next page. If finished (S11: YES), the MFP 1 ends the printing process of FIG. 6.

Figure 7:
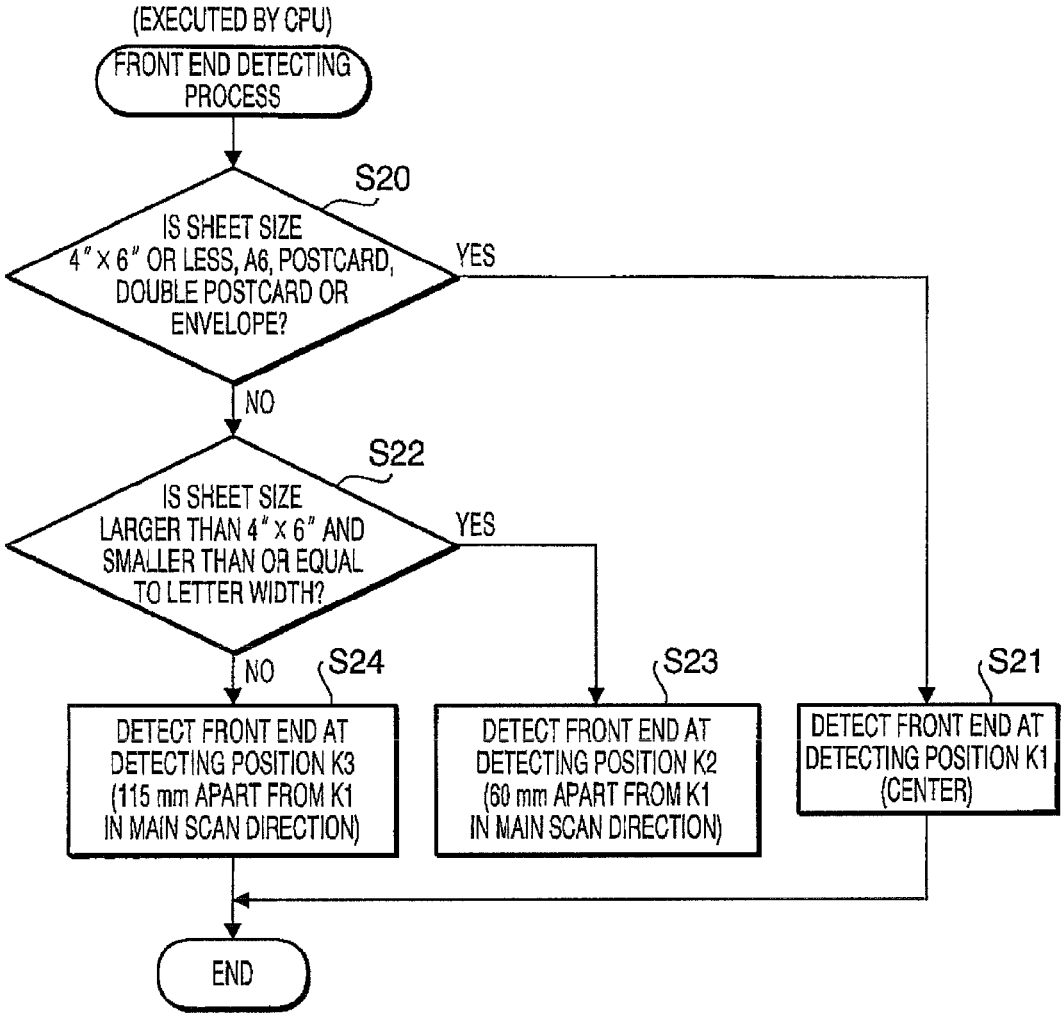
FIG. 7 is a flow chart showing a front end detecting process (S4 in FIG. 6).
Figure 8:
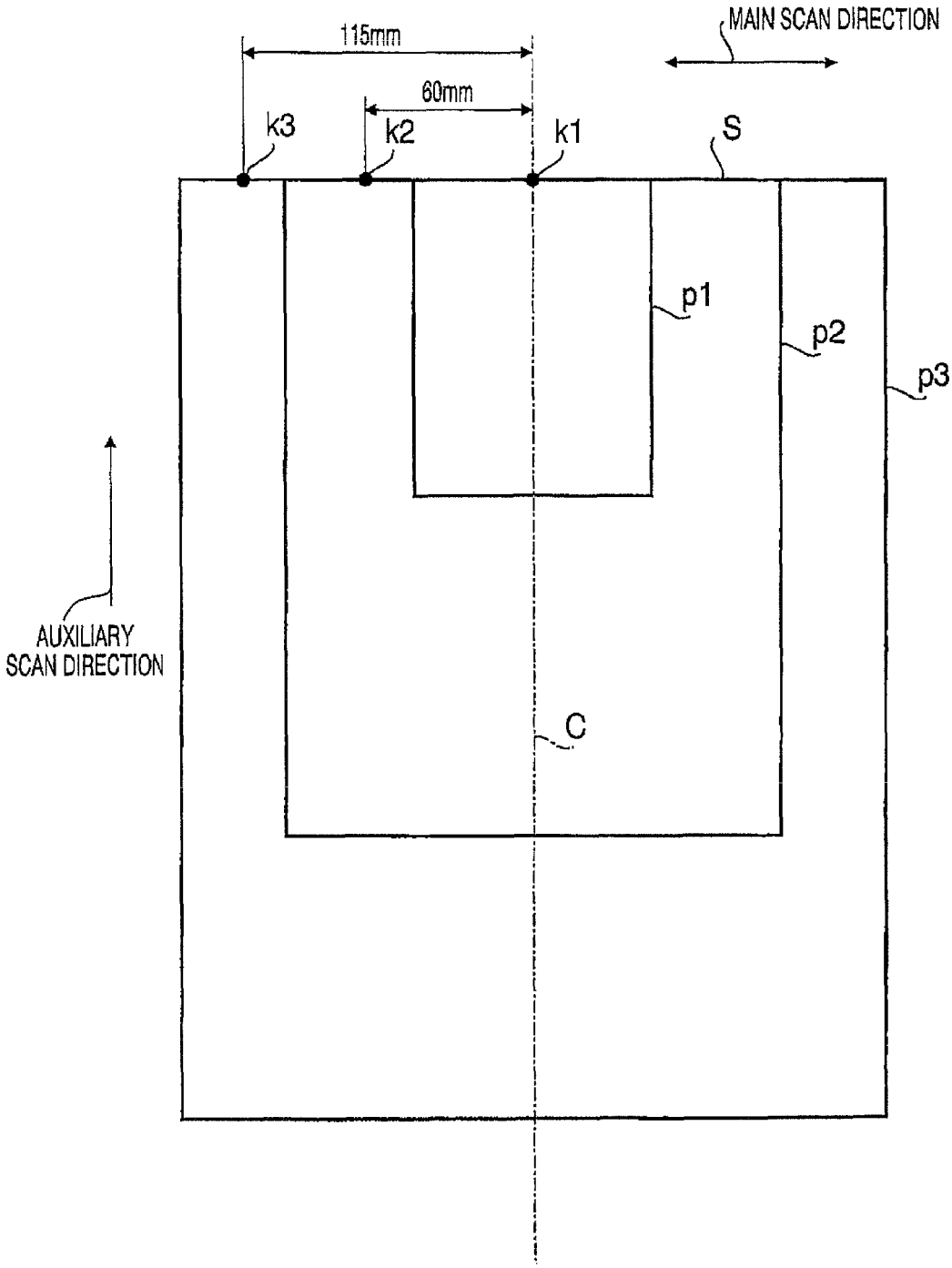
FIG. 8 is a schematic diagram showing the relationship between sheets P1, P2 and P3 (differing in the sheet size) and detecting positions K1, K2 and K3 for them.

Next, the details of the front end detecting process (S4 in FIG. 6) will be described with reference to FIGS. 7 and 8. FIG. 7 is a flow chart showing the front end detecting process. FIG. 8 is a schematic diagram showing the relationship between sheets P1, P2 and P3 (differing in the sheet size) and detecting positions K1, K2 and K3 for them.

In FIG. 8, the horizontal direction corresponds to the main scan direction in which the carriage 20 moves to and fro, while the vertical direction (upward) corresponds to the sheet feed direction (auxiliary scan direction) in which each sheet P is fed. The reference character "C" represents a central position (in regard to the main scan direction) corresponding to the center line (extending in the auxiliary scan direction) of each sheet P being fed, and "S" represents the front end of each sheet P in the sheet feed direction.

The front end detecting process is a process for detecting whether or not the front end S of the sheet P being fed in the auxiliary scan direction (sheet feed direction) exists at (passes through) the position facing the media sensor 51 mounted on the carriage 20. Further, the position of (the front end S of) the sheet P in the sheet feed direction with respect to the print head 21 is determined (detected) based on the detection of the passage of the front end S by the media sensor 51. By the front end detecting process, whether a sheet in a size different from the sheet size specified by the print command has been fed or not can be checked with ease and in a short time.

First, the MFP 1 (specifically, the CPU 65 (ditto for the following steps)) judges whether or not the sheet size specified by size information included in the print command is 4"×6" or less, A6, postcard size, double postcard size or one of various envelope sizes (S20). When the specified sheet size is 4"×6" or less, A6, postcard size, double postcard size or one of various envelope sizes (S20: YES), the MFP 1 moves the carriage 20 so as to place the media sensor 51 at the detecting position K1 (facing the central position C) and makes the media sensor 51 detect whether or not the sheet exists at the position (i.e. whether or not the front end S of the sheet passes through the position (ditto for the following explanation)) facing the detecting position K1 (i.e. facing the media sensor 51) (S21).

As shown in FIG. 8, each sheet P1, P2, P3 (differing in the sheet size) is fed so that its center line (extending in the auxiliary scan direction) coincides with the central position C irrespective of the sheet size. In other words, any sheet of any size necessarily passes under the detecting position K1. Therefore, the detection regarding whether a sheet in a size different from the sheet size specified by the print command has been fed or not can not be made at the detecting position K1.

Meanwhile, there is a possibility that a postage stamp has already been affixed to a corner of a postcard, double postcard or envelope. Thus, in cases where the sheet specified by the print command is a postcard, double postcard or envelope, it is possible to prevent false detection by the media sensor 51 (erroneously detecting the postage stamp), by setting the detecting position at the detecting position K1 (at the center).

Returning to FIG. 7, when the sheet size specified by the print command is not 4"×6" or less, A6, postcard size, double postcard size or one of various envelope sizes (S20: NO), the MFP 1 judges whether or not the sheet size specified by the print command (size information) is larger than 4"×6" and smaller than or equal to "letter width" (8.5"=approximately 216 mm) (S22). When the specified sheet size is larger than 4"×6" and smaller than or equal to the letter width (S22: YES), the MFP 1 moves the carriage 20 so as to place the media sensor 51 at the detecting position K2 (60 mm apart from the detecting position K1 (center) in the main scan direction) and makes the media sensor 51 detect whether or not the sheet exists at the position facing the detecting position K2 (i.e. facing the media sensor 51) (S23).

Specifically, the width of a sheet of the 4"×6" size is approximately 102 mm, and thus the distance (in the main scan direction) between the central position C and the outermost position through which the 4"×6" sheet can pass is approximately 51 mm (half width as shown in FIG. 8). Meanwhile, the detecting position K2 is set to be 60 mm apart (in the main scan direction, leftward in FIG. 8) from the detecting position K1 (center) in this embodiment.

Therefore, a sheet P1 having a width less than or equal to that of the 4"×6" sheet (4 inches=approximately 102 mm) does not pass through the position facing the detecting position K2 and is not detected by the media sensor 51.

Examples of such a sheet P1 (whose width is less than or equal to that of the 4"×6" sheet) include an L-size sheet (width: approximately 89 mm), a postcard (width: approximately 97 mm), a Japanese postcard (width: approximately 100 mm) and the 4"×6" sheet (width: approximately 102 mm). Since the width of such a sheet P1 is less than or equal to that of the 4"×6" sheet (102 mm), the half width of the sheet P1 from the central position C is of course less than 60 mm, and thus the sheet P1 does not pass through the position facing the detecting position K2 and is not detected by the media sensor 51.

In this case where the sheet is not detected at the detecting position K2, it can be presumed that a sheet P1 of a size smaller than or equal to 4"×6" has been fed even though the sheet size specified by the print command is larger than 4"×6" and smaller than or equal to the letter width (S22: YES). Thus, in this case, the MFP 1 ejects the currently fed sheet without executing the printing thereon as explained above.

As above, in the case where the sheet size specified by the print command is larger than 4"×6" and smaller than or equal to the letter width (S22: YES), at least whether the sheet which has been fed is smaller than the sheet size specified by the print command or not can be checked with ease and in a short time by moving the carriage 20 (media sensor 51) to the detecting position K2 and detecting (checking) whether the sheet exists at the detecting position K2 or not before executing the printing.

Returning to FIG. 7, when the condition "the sheet size specified by the print command (size information) is larger than b 4"×6" and smaller than or equal to the letter width" is not satisfied in S22 (S22: NO), the MFP 1 moves the carriage 20 so as to place the media sensor 51 at the detecting position K3 (115 mm apart from the detecting position K1 (center) in the main scan direction) and makes the media sensor 51 detect whether or not the sheet exists at the position facing the detecting position K3 (i.e. facing the media sensor 51) (S24).

Specifically, the width of a sheet of the letter size is approximately 216 mm, and thus the distance (in the main scan direction) between the central position C and the outermost position through which the letter-size sheet can pass is approximately 108 mm (half width as shown in FIG. 8).

Meanwhile, the detecting position K3 is set to be 115 mm apart (leftward in FIG. 8) from the detecting position K1 (center) in this embodiment.

Therefore, a sheet (P1, P2) having a width less than or equal to that of the letter-size sheet (approximately 216 mm) does not pass through the position facing the detecting position K3 and is not detected by the media sensor 51.

Examples of the size of such a sheet (whose width is less than or equal to that of the letter-size sheet) include 2 L (width: approximately 127 mm), B6 (width: approximately 128 mm), duodecimo (width: approximately 128 mm), A5 (width: approximately 148 mm), B5 (width: approximately 182 mm), A4 (width: approximately 210 mm), legal (width: approximately 216 mm) and letter (width: approximately 216 mm), in addition to the aforementioned L size, postcard, Japanese postcard and 4"×6". Since the width of such a sheet is less than or equal to that of the letter-size sheet (216 mm), the half width of the sheet from the central position C is of course less than 115 mm, and thus the sheet does not pass through the position facing the detecting position K3 and is not detected by the media sensor 51.

In this case where the sheet is not detected at the detecting position K3, it can be presumed that a sheet of a size smaller than or equal to the letter size has been fed even though the sheet size specified by the print command is larger than the letter size (S22: NO). Thus, in this case, the MFP 1 ejects the currently fed sheet without executing the printing thereon as explained above.

As above, in the case where the sheet size specified by the print command is larger than the letter size (S22: NO), at least whether the sheet which has been fed is smaller than the sheet size specified by the print command or not can be checked with ease and in a short time by moving the carriage 20 (media sensor 51) to the detecting position K3 and detecting (checking) whether the sheet exists at the detecting position K3 or not before executing the printing.

While a description has been given above of a preferred embodiments in accordance with the present invention, the present invention is not to be restricted by the particular illustrative embodiment and a variety of modifications, design changes, etc. are possible without departing from the scope and spirit of the present invention described in the appended claims.

For example, while the detecting position for the media sensor 51 is selected (depending on the sheet size) from three detecting positions (K1, K2, K3) in the above embodiment, the number of the detecting positions is not restricted to three. For example, it is possible to set four or more detecting positions corresponding to typical sheet sizes. In this case, the judgment on whether a sheet in a size different from the sheet size specified by the print command has been fed or not can be made more precisely.

While whether to execute the width detection process (detecting the position of the sheet in the main scan direction) or not is determined depending on the resolution specified by the print command in the printing process (FIG. 6) in the above embodiment, the printing process may also be configured to carry out both the front end detecting process (S4) and the width detecting process (S9) irrespective of the specified resolution in cases where the so-called "borderless printing" (printing an image on a sheet without forming the margin around the image) is specified by the print command.

While the MFP 1 in the above embodiment ejects the currently fed sheet without executing printing thereon when the sheet is not detected at the detecting position, the MFP 1 may also be configured to detect the width of the sheet with the media sensor 51 when the sheet is not detected at the detecting position, process the print data so that the inks will not be discharged to the outside of detected sheet width, and execute the printing on the sheet by use of the processed print data.

While an MFP has been described as an example of an inkjet printing device in the above embodiment, the present invention is of course applicable to various types of inkjet printing devices (inkjet printer, facsimile machine employing an inkjet printing unit, etc.).

What is claimed is:

1. An inkjet printing device comprising:
- a print head which discharges ink onto a sheet;
- a carriage on which the print head is mounted and which moves to and fro in a main scan direction while facing the sheet;
- a detector unit which is mounted on the carriage and detects presence/absence of the sheet at a detecting position in the main scan direction;
- an acquisition unit which acquires a print command including size information specifying size of the sheet for which printing is requested;
- a setting unit which sets the detecting position depending on the size information included in the print command acquired by the acquisition unit;
- a moving unit which moves the carriage to locate the detector unit at the detecting position set by the setting unit; and
- a checking unit which checks whether the sheet is present/absent at the detecting position by use of the detector unit located at the detecting position.

2. The inkjet printing device according to claim 1, wherein the setting unit sets the detecting position as a position facing a passing position through which a sheet in a size specified by the size information can pass, while excluding inner positions, through which a sheet whose width in the main scan direction is smaller than that specified by the size information can pass, from the passing position.

3. The inkjet printing device according to claim 1,
- further comprising a postal judgment unit which judges whether the size specified by the size information is one of postcard size, double postcard size and one of various envelope sizes,
- wherein the setting unit sets the detecting position at a position facing a central position at the center of the width of the sheet in the postcard size, the double postcard size or one of various envelope sizes in the main scan direction when the size specified by the size information is judged to be the postcard size, the double postcard size or one of various envelope sizes by the postal judgment unit.

4. The inkjet printing device according to claim 1, further comprising an ejection unit which ejects the sheet before undergoing the printing according to the print command when the checking unit detects that the sheet is absent at the detecting position.

5. The inkjet printing device according to claim 1,
- further comprising:
- a resolution judgment unit which judges whether resolution included in the print command acquired by the acquisition unit is equal to or higher than a first threshold value;
- a leading end detecting unit which detects a leading end of the sheet in an auxiliary scan direction by use of the setting unit, the moving unit and the checking unit when the resolution is judged to be equal to or higher than the first threshold value by the resolution judgment unit.

6. The inkjet printing device according to claim 5, wherein the leading end detecting unit does not detects the leading end of the sheet in the auxiliary scan direction when the resolution is judged to be less than the first threshold value by the resolution judgment unit.

7. The inkjet printing device according to claim 5, wherein:

the resolution judgment unit judges whether or not the resolution included in the print command is higher than a second threshold value, and the inkjet printing device further comprises a width detecting unit which detects presence of the sheet at the detecting position in the main scan direction by use of the detector unit when the resolution is judged to be higher than the second threshold value by the resolution judgment unit.

8. The inkjet printing device according to claim 7, wherein:

the resolution judgment unit judges whether the resolution included in the print command is higher than a third threshold value which is higher than the second threshold value, and the width detecting unit carries out the detection of presence of the sheet for all pages when the resolution judgment unit judges that the resolution is higher than the third threshold value, and the width detecting unit carries out the detection of presence of the sheet for only one page when resolution judgment unit judges that the resolution is higher than the third threshold value but equal to or less than the second threshold value.

9. The inkjet printing device according to claim 8, wherein:

the resolution judgment unit judges whether the resolution included in the print command is higher than a third threshold value which is higher than the second threshold value, and the width detecting unit carries out the detection of presence of the sheet for all pages when the resolution judgment unit judges that the resolution is higher than the third threshold value, and the width detecting unit carries out the detection of presence of the sheet for only one page when resolution judgment unit judges that the resolution is higher than the third threshold value but equal to or less than the second threshold value.

10. A computer-readable storage device storing computer-readable instructions that cause a computer of an inkjet printing device, equipped with a print head which discharges ink onto a sheet, a carriage on which the print head is mounted and which moves to and fro in a main scan direction while facing the sheet, and a detector which is mounted on the carriage and detect presence/absence of the sheet at a detecting position, to execute:

an acquisition step of acquiring a print command including size information specifying size of the sheet for which printing is requested;

a setting step of setting the detecting position depending on the size information included in the print command acquired by the acquisition step;

a moving step of moving the carriage to locate the detector at the detecting position set by the setting step; and a checking step of checking presence/absence of the sheet at the detecting position by use of the detector located at the detecting position.

11. The computer-readable storage device according to claim 10, wherein the setting step sets the detecting position as a position facing a passing position through which a sheet in a size specified by the size information can pass, while excluding inner positions, through which a sheet whose width in the main scan direction is smaller than that specified by the size information can pass, from the passing position.

12. The computer-readable storage device according to claim 10, further comprising a postal judgment step which judges whether the size specified by the size information is one of postcard size, double postcard size and one of various envelope sizes, wherein the setting step sets the detecting position at a position facing a central position at the center of the width of the sheet in the postcard size, the double postcard size or one of various envelope sizes in the main scan direction when the size specified by the size information is judged to be the postcard size, the double postcard size or one of various envelope sizes by the postal judgment step.

13. The computer-readable storage device according to claim 10, further comprising an ejection step which ejects the sheet before undergoing the printing according to the print command when the checking step detects that the sheet is absent at the detecting position.

14. The computer readable storage device according to claim 10, further comprising:

a resolution judgment step which judges whether resolution included in the print command acquired by the acquisition step is equal to or higher than a first threshold value;

a leading end detecting step which detects a leading end of the sheet in an auxiliary scan direction by use of the setting step, the moving step and the checking step when the resolution is judged to be equal to or higher than the first threshold value by the resolution judgment step.

15. The computer-readable storage device according to claim 14, wherein the leading end detecting step does not detect the leading end of the sheet in the auxiliary scan direction when the resolution is judged to be less than the first threshold value by the resolution judgment step.

16. The computer-readable storage device according to claim 14, wherein:

the resolution judgment step judges whether or not the resolution included in the print command is higher than a second threshold value, and the inkjet printing device further comprises a width detecting step which detects presence of the sheet at the detecting position in the main scan direction by use of the detector step when the resolution is judged to be higher than the second threshold value by the resolution judgment step.

17. The computer-readable storage device according to claim 16, wherein:

the resolution judgment step judges whether the resolution included in the print command is higher than a third threshold value which is higher than the second threshold value, and the width detecting step carries out the detection of presence of the sheet for all pages when the resolution judgment step judges that the resolution is higher than the third threshold value, and the width detecting step carries out the detection of presence of the sheet for only one page when resolution judgment step judges that the resolution is higher than the third threshold value but equal to or less than the second threshold value.

18. The computer readable storage device according to claim 17, wherein:

the resolution judgment step judges whether the resolution included in the print command is higher than a third threshold value which is higher than the second threshold value, and the width detecting step carries out the detection of presence of the sheet for all pages when the resolution judgment step judges that the resolution is higher than the third threshold value, and the width detecting step carries out the detection of presence of the sheet for only one page when resolution judgment step judges that the resolution is higher than the third threshold value but equal to or less than the second threshold value.

19. A method of checking presence/absence of a sheet for an inkjet printing device which is equipped with a print head which discharges ink onto a sheet, a carriage on which the print head is mounted and which moves to and fro in a main scan direction while facing the sheet, and a detector which is mounted on the carriage and detect presence/absence of the sheet at a detecting position, the method comprising:

an acquisition step of acquiring a print command including size information specifying size of the sheet for which printing is requested;

a setting step of setting the detecting position depending on the size information included in the print command acquired by the acquisition step;

a moving step of moving the carriage to locate the detector at the detecting position set by the setting step; and a checking step of checking presence/absence of the sheet at the detecting position by use of the detector located at the detecting position.

* * * * *